US012595798B1

(12) United States Patent
Luong et al.

(10) Patent No.: US 12,595,798 B1
(45) Date of Patent: Apr. 7, 2026

(54) DISPOSABLE IMPELLER ASSEMBLY FOR A MAGNETIC DRIVE PUMP AND RELATED METHODS

(71) Applicant: Lexor, Inc., Westminster, CA (US)

(72) Inventors: Christopher Luong, Westminster, CA (US); Nguyen Le, Long Hau (VN); Nam Le, Long Hau (VN)

(73) Assignee: Lexor, Inc., Westminster, CA (US)

( * ) Notice: Subject to any disclaimer, the term of this patent is extended or adjusted under 35 U.S.C. 154(b) by 0 days.

(21) Appl. No.: 18/999,035

(22) Filed: Dec. 23, 2024

(51) Int. Cl.

| | |
|---|---|
| ***F04D 13/02*** | (2006.01) |
| ***F04D 1/00*** | (2006.01) |
| ***F04D 13/06*** | (2006.01) |
| ***F04D 13/08*** | (2006.01) |
| ***F04D 25/02*** | (2006.01) |
| ***F04D 29/42*** | (2006.01) |
| ***F04D 29/60*** | (2006.01) |
| ***F04D 29/62*** | (2006.01) |

(52) U.S. Cl.
CPC ..... *F04D 13/024* (2013.01); *F04D 13/026* (2013.01); *F04D 13/027* (2013.01); *F04D 13/0666* (2013.01); *F04D 13/08* (2013.01); *F04D 25/026* (2013.01); *F04D 29/426* (2013.01); *F04D 29/605* (2013.01); *F04D 29/628* (2013.01); *F04D 1/00* (2013.01)

(58) Field of Classification Search
CPC .... F04D 13/026; F04D 13/027; F04D 13/024; F04D 29/426; F04D 29/628; F04D 13/0666; F04D 29/605; F04D 25/026; F04D 13/08
See application file for complete search history.

(56) References Cited

U.S. PATENT DOCUMENTS 9,205,023 B2 * 12/2015 Tran ..... A61H 33/6063
2022/0412365 A1 * 12/2022 Alexander ..... F04D 29/406

* cited by examiner

*Primary Examiner* — Peter J Bertheaud
(74) *Attorney, Agent, or Firm* — Alumen IP Law PC

(57) ABSTRACT

A pump for a spa device including a motor having a drive shaft and a magnetic drive plate attached thereto. The pump further includes an impeller assembly magnetically coupled to the magnetic drive plate of the motor. The impeller assembly is configured to be disposable.

29 Claims, 11 Drawing Sheets

DISPOSABLE IMPELLER ASSEMBLY FOR A MAGNETIC DRIVE PUMP AND RELATED METHODS

FIELD OF ART

The present disclosure is generally directed to apparatuses and methods for spa devices and more particularly to a magnetic drive pump for providing a hydrotherapy experience, such as a massage, via a jet stream within the spa device and related methods.

BACKGROUND

Spa devices, components, and systems thereof are known in the art. Spa devices are used in commercial and recreational settings for hydrotherapy, massage, stimulation, pedicure, and bathing purposes. Typical spa devices include a motor that drives a pump to circulate water from the spa device. In particular, a shaft of the motor is used to directly mount an impeller, which is then used to circulate water into and out of the spa device. A seal or a series of seals may be required to prevent water from entering the motor. Overtime, the seals may wear to the point where water will enter the motor and consequently, the entering water may cause the motor to burn out. At this point, the motor assembly may be replaced in order to continue operation of the spa device. This is expensive and may take several hours in which to perform. Additionally, because typical spa devices have extensive piping systems that are built into the body of the spa device to transport water, the spa devices are traditionally difficult to clean. This results in downtime and complicated maintenance schedules to clean such spa devices.

In the spa application environment, water is commonly added with certain substances and/or products, such as salt, chemicals, sand, massage lotions, etc. Due to this fact, traditional bearings, such as ball bearings and metal bushings, will not be suitable for a long term and reliable operation. The presence of chemicals and sand, for example, will cause some or many currently available bearings to wear out quicker than normal and result in pump failures.

In addition, for magnetic coupling-type pumps, it is almost impossible to have a perfect alignment between the motor shaft axis and the impeller rotation axis. The imperfect alignment or misalignment will result in high vibration noise. Furthermore, given the relatively high cost of magnets, such magnetic coupling-type pumps can be cost prohibitive.

SUMMARY

Broadly speaking, aspects of the invention are directed to systems and methods for providing magnetic drive pumps which may be usable in spa devices. Each magnetic drive pump may have a disposable impeller assembly, wherein the impeller and/or the housing therefore may be easily, and cost-effectively, disposed of and replaced by hand without the need for tools.

Aspects of the invention include a pump for a spa device. The pump includes a motor having a drive shaft and a magnetic drive plate attached thereto. The pump further includes an impeller assembly magnetically coupled to the magnetic drive plate of the motor. The impeller assembly is configured to be disposable.

Aspects of the invention further include pump for a spa device. The pump includes a motor having a drive shaft and a magnetic drive plate attached thereto. The pump further includes an impeller assembly that comprises a housing having at least one inlet and at least one discharge nozzle and an impeller housed within the housing. The impeller includes a plurality of vanes configured to generate a fluid stream expelled out through the at least one discharge nozzle. The impeller assembly further includes a first plate connected to a rear surface of the impeller. The first plate is comprised of a ferrous material. The first plate is configured to magnetically engage with the magnetic drive plate of the motor for linearly and removably connecting the impeller, and the housing of the impeller assembly therewith, to the motor. The impeller assembly further includes a second plate connected to and covering the first plate. The second plate is comprised of a paramagnetic material. The second plate is configured to magnetically engage with the magnetic drive plate of the motor to rotate the impeller via a braking force generated by resulting eddy currents within the second plate.

Aspects of the invention further include a method of assembling a spa pump. The method includes attaching a motor having a drive shaft and a magnetic drive plate attached thereto. The magnetic drive plate includes a series of north and south magnets. The method further includes attaching a pair of plates to an impeller. The pair of plates includes a first, ferrous plate and a second, paramagnetic plate. The method further includes placing the impeller, with the plates attached thereto, within a housing. The method further includes removably attaching the housing onto the motor. The first and second plates are configured to magnetically couple the impeller to the magnetic drive plate of the motor such that the housing is held against the motor via an axial magnetic force generated by the first plate, and the impeller rotates within the housing via a rotational magnetic force generated by the second plate.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of a spa device with one or more magnetic drive pumps, in accordance with aspects of the present devices, systems, and methods, and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
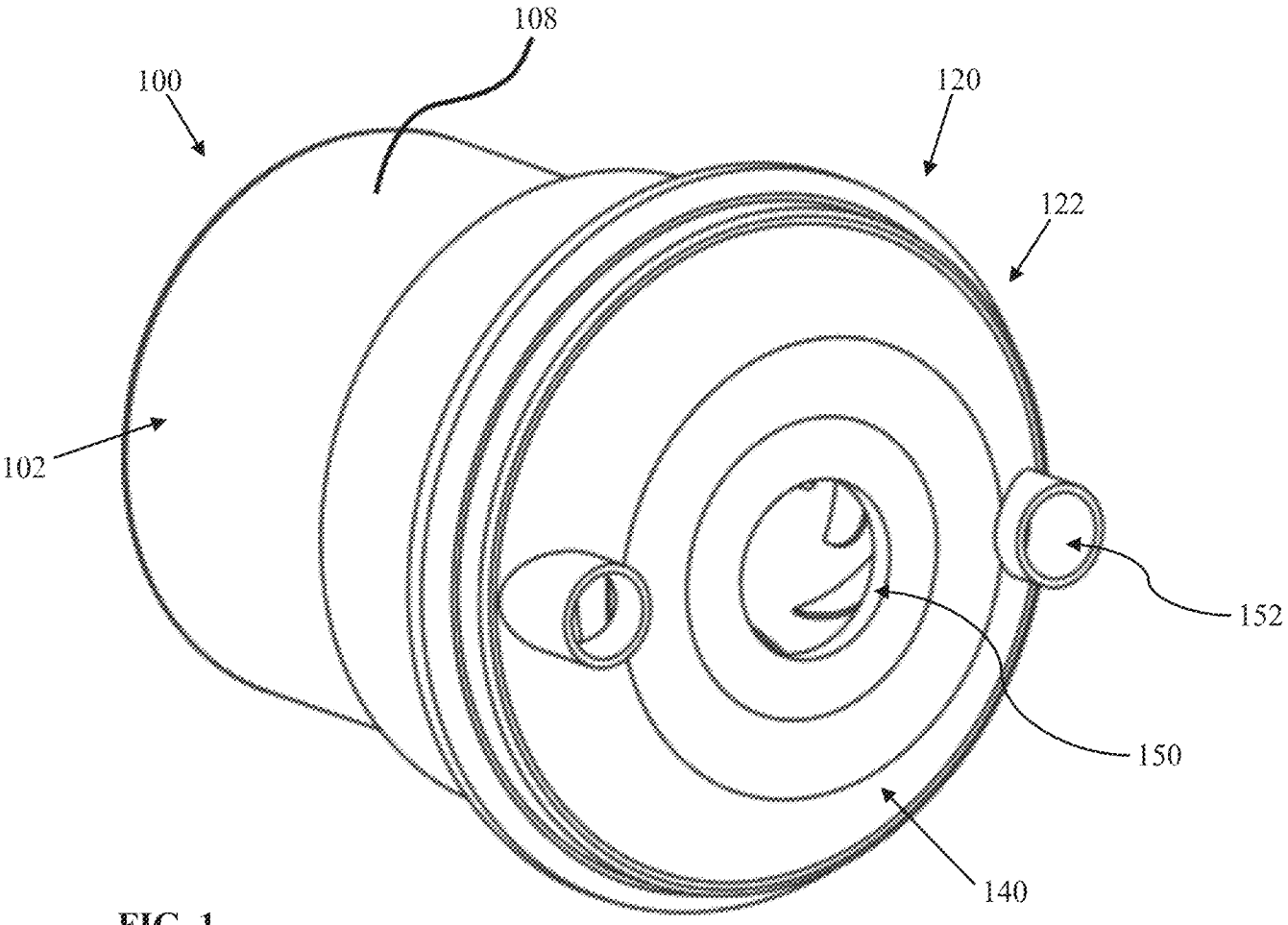
FIG. 1 illustrates a front perspective view of an embodiment of a magnetic drive pump with a disposable impeller assembly for a spa device.
Figure 2:
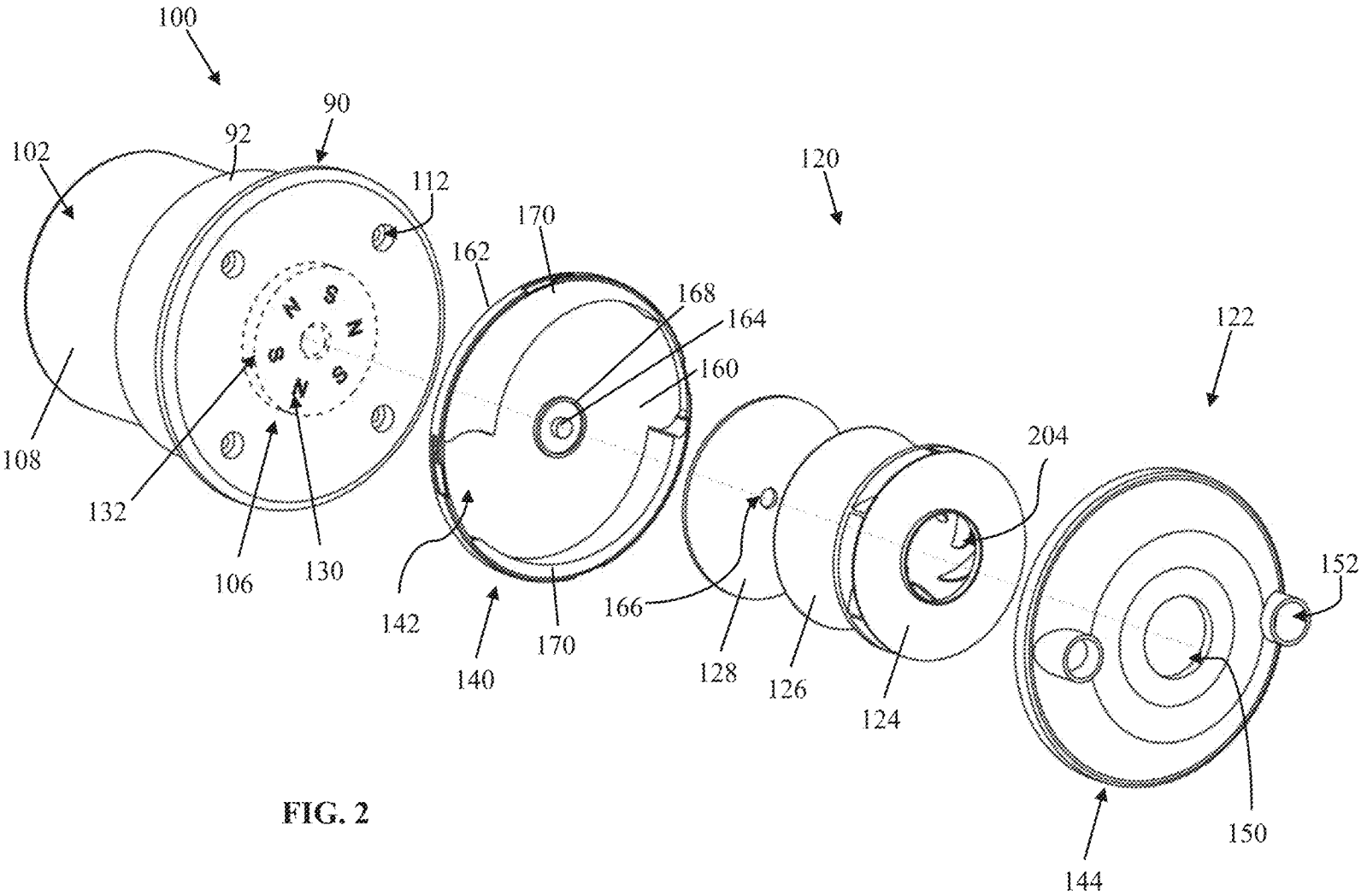
FIG. 2 illustrates an exploded view of the pump of FIG. 1.
Figure 3:
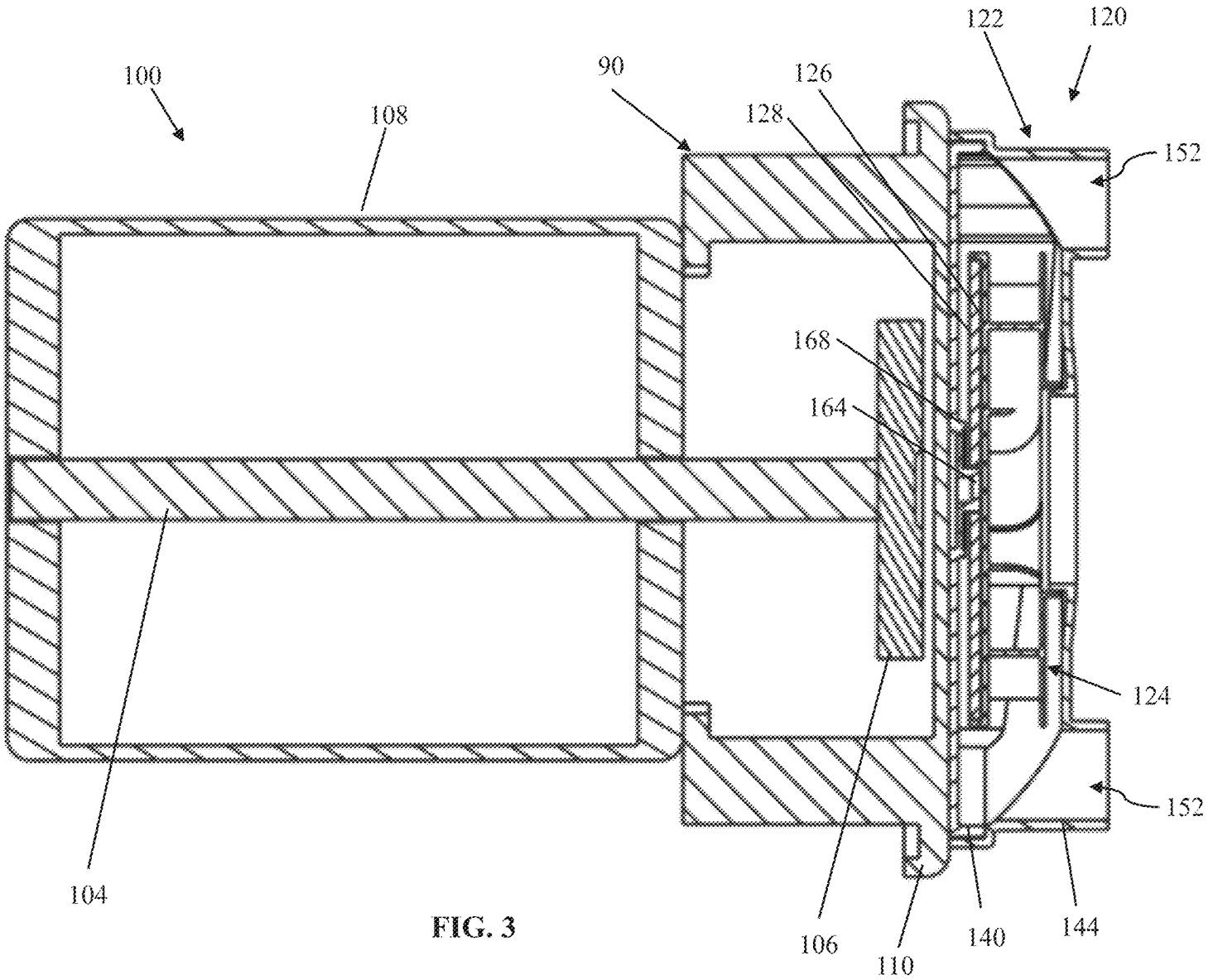
FIG. 3 illustrates a cross-sectional view of the pump of FIG. 1.

Referring to FIGS. 1-3, there is shown in one embodiment, a pump 100 that is usable in any desired fluid system or spa device 10 (FIG. 10), including a spa, a swim spa, a pool, a spa chair, or a bathtub (as discussed below with reference to FIGS. 10-12). The pump 100, which may also be referred to as a magnetic drive pump, generally includes a motor 102, with a drive shaft 104, a magnetic drive plate 106 attached thereto, and a motor housing or casing 108, and an impeller or jet assembly 120 magnetically coupled to the magnetic drive plate 106 of the motor 102 (FIG. 3). The impeller assembly 120 is held in its operational position (FIG. 1) and driven solely by the magnetic forces of the magnetic drive plate 106 of the motor 102, without a physical impeller drive shaft driven by the motor connected to the impeller to turn the impeller. Referring specifically to FIG. 2, the impeller assembly 120 generally includes a housing 122, an impeller 124, and a pair of plates 126, 128, including a first, ferrous plate 126 and a second, paramagnetic (i.e., conductive) plate 128 attached to the impeller 124. The jet assembly 120 is secured against the body 92 of the mount adaptor 90 via magnetic attraction between the magnetic drive plate 106 and the first plate or ferrous plate 126, which magnetically draws the first plate against the magnetic drive plate and draws the housing 122 that holds the impeller to the mount assembly to hold the entire impeller assembly 120 onto the motor 102. The mount adaptor 90 is structured to mount to the front end of the motor 102 to cover the magnetic drive plate 106 and to secure the motor and jet assembly to the basin, tub, spa, pool, or bathtub, as further discussed below. The mount adaptor 90 can be structurally similar to the mount adaptor disclosed in US Pub. No. 2022/0000710 to Luong, the contents of which are expressly incorporated herein by reference.

The impeller assembly 120 is configured to be disposable, allowing the entire impeller assembly 120 to be easily, quickly, and cost-effectively removed and thereafter replaced by hand. Although impeller assembly is configured for a one-time use and disposable, the impeller assembly is structurally stable and built for repeated use. The user need not use any tools or have a technical knowledge of the spa pump 100 to remove and replace the impeller assembly 120, as the impeller assembly 120 is self-aligning and automatically attaches to the motor 102. The magnetic forces of the magnetic drive plate 106 mounted to the drive shaft 104 of the motor 102 dually retain and operate the impeller assembly 120 such that the impeller assembly 120 is held in its operational position as shown in FIG. 1 (directly against the motor housing 108 or an adapter, as discussed further herein) and driven solely by the magnetic forces acting on the impeller assembly 120, such as acting on the first plate of the impeller. To replace a given impeller assembly 120, a user grabs the impeller assembly 120 and pulls the impeller assembly 120 away from the motor 102, thus overcoming a linear magnetic puling or holding force acting on the impeller assembly 120. Thereafter, the user can dispose of the old impeller assembly 120 and positions a new impeller assembly 120 against the mount adaptor 90 next to the motor 102. Thus, the motor 102 can readily separate from the used impeller assembly and quickly accepts a new impeller assembly 120 via integrated mating features and the magnetic holding force which self-aligns and retains the new impeller assembly 120 onto the motor 102.

Furthermore, the spa pump 100 may be used with various fluid additives, such as a scent, cleaning agent or other chemical, lotion, fluid dye, bath salt or other exfoliant, or other additive. Additionally, particulate matter, such as dirt, dead skin flakes from desquamation, or other foreign objects may be present in the fluid. Over time, these additives and/or particulate matter may buildup in the impeller assembly 120, clogging or otherwise making the impeller assembly 120 unsanitary. If the impeller assembly 120 becomes unsanitary, broken, clogged with particulate matter, such as dirt, a chemical film, foreign objects, etc., or otherwise undesirable, the user may readily replace the old impeller assembly 120 (or portion thereof such as the housing 122 and/or the impeller 124) with a new impeller assembly 120 by hand and without the use of tools or a pump technician with intricate knowledge of the spa pump 100. Additionally, as discussed further herein, the impeller assembly 120 may be composed of a plastic material, with internal structural support members therein, for providing a cost-effective and sturdy impeller assembly 120 that can be cost-effectively replaced as desired after one or more uses. Thereby, the spa pump 100 as disclosed herein may provide a more pleasurable and sanitary spa experience, in comparison to prior art spa pumps, via the durable, efficient, and easily replaceable impeller assemblies 120.

The motor 102 can be configured to dually mount and drive the impeller assembly 120. The motor 102 may be connected to a wall or other frame member of the spa device 10. In one embodiment, the motor housing 108 may be directly connected to and fitted within a designated through hole or compartment in the wall of the spa device 10. In such an embodiment, the impeller assembly 120 may mount directly onto a front face of a flanged front end 110 the motor housing 108 (FIG. 3), which may or may not extend outwardly beyond the wall of the spa device 10. In another embodiment, a mount adapter (not shown) may connect the motor 102 to the wall of the spa device 10 and also mount the impeller assembly 120 onto a front face thereof. Exemplary mount adapters for a motor 102 are described in US Pub. No. 2022/0000710, previously referenced and incorporated herein by reference. In such an embodiment with a mount adapter, the drive shaft 104 may extend axially out the motor housing 108 and into the mount adapter such that the magnetic drive plate 106 is located within the body of the mount adapter. The motor housing 108 and/or the mount adapter can be connected to the spa device 10 via any desired fastener, e.g., screws, bolts, etc., or mating features, e.g., press-fit or threaded into the hole in the wall of the spa device 10. A gasket may be included to between the mount adaptor and the wall of the spa device for improved sealing at the interface.

In one embodiment, the motor 102 may comprise an electric motor. The electric motor 102 may include a stator, which is fixed to the motor housing 108, and a rotor that is attached to the drive shaft 104 for effecting the rotational movement thereof. In an example, the motor 102 may comprise a single phase asynchronous or induction motor rated for 120 VAC, 60 Hz, with an amp rating of 0.5-0.8 A. The motor 102 may be connected to electrical wiring, which is configured to be connected to a power source when mounted to the spa device 10, such as an AC electrical outlet or to a power supply locally contained within the spa device 10 (not shown). However, the motor rating is not limited to the exemplary spec provided herein.

With specific reference to FIG. 2, the magnetic drive plate 106 may include a series of alternating north and south magnets 130, 132 that are configured to magnetically engage with the first and second plates 126, 128. In particular, the north, or south, magnets 130, 132 may magnetically couple to the first, ferrous plate 126, which thereby applies a linear magnetic holding or pulling force that pulls the impeller 124 against the impeller housing 122, and in turn, the impeller housing 122 onto the motor housing 108 (or mount adapter if separately mounted to the motor housing). Additionally, the north and south magnets 130, 132, when rotated by the motor 102, induce an alternating north and south magnetic field through the second, paramagnetic plate 128. The alternating magnetic field causes eddy currents to flow within the second plate 128, which in turn generates a braking force, due to Lenz's law, that rotates the second plate 128 (and first plate 126 and the impeller 124 therewith). In detail, the second plate 128 rotates in tandem with the magnetic drive plate 106 because the resulting eddy currents (caused by the alternating north and south magnetic field) generate individual magnetic fields that opposes the rotational movement of the magnetic drive plate 106 (i.e., generating a collective braking force) which in turn forces the second plate 128 to rotate in the same rotational direction as the magnetic drive plate 106. Thereby, the plates 126, 128 act in tandem to dually hold the impeller assembly 120 onto the motor 102 and rotate the impeller 124. Thus, the impeller 124 can rotate within the enclosed housing 122 without any direct connection to the drive shaft of the motor 102, using only the magnetic drive force generated by the braking force of the second plate 128, caused by the eddy currents therein. Furthermore, the impeller assembly 120 is freely detachable from the motor 102 by hand because there is no direct connection between impeller assembly 120 and the drive shaft of the motor 102.

The magnetic drive plate 106 may be housed within the motor housing 108 or a mount adapter. The magnetic drive plate 106 may be located next to a rear surface of the front end 110 of the motor housing 108 (or mount adapter). In one embodiment, the magnetic drive plate 106 may comprise an annular disc or ring with integrated north and south magnets 130, 132. In one embodiment, the magnetic drive plate 106 may comprise a base plate and multiple individual north and south magnets 130, 132 rigidly attached to and circumferentially disposed about the base plate. In one embodiment, the magnetic drive plate 106 includes three north magnets 130 and three south magnets 132, disposed in an alternating configuration. Each magnet 130, 132 may comprise any desired magnet. For example, magnets usable with the magnetic drive plate 106 can be a permanent magnet of the neodymium iron boron (NdFeB) type, samarium cobalt (SmCo) type, alnico type, or ceramic or ferrite magnets, or combinations thereof. The magnetic drive plate 106 may be rigidly attached to an end of the drive 104 shaft via one or more fasteners, such as a lock nut, screw, and/or other fastener(s). In one embodiment, the drive shaft 104 can have a keyway or a chamfered section and the magnetic drive plate 106 can have a correspondingly shaped bore to receive the drive shaft 104 or receive part of the drive shaft 104. As shown, the magnetic drive plate 106 is round with a thickness or depth and a central opening for accommodating the drive shaft 104 and the fastener. Given the direct connection of the magnetic drive plate 106 onto the end of the drive shaft 104, when the motor 102 is powered on to rotate the rotor, which then rotates the drive shaft 104, the magnetic drive plate 106 also rotates at the speed of the drive shaft 104.

Referring now to FIGS. 4-8, the impeller assembly 120 may include a multipart housing 122 which houses and fully encases the impeller 124 and plates 126, 128 therein. The housing 122 can be considered or called an impeller or pump housing 122. From left to right in FIGS. 5 and 6, in one embodiment, the housing 122 may include a housing base 140 that receives the impeller 124 and the plates 126, 128 in an impeller compartment 142 thereof, and a housing cover 144 that removably connects to the housing base 140 via complimentary mating features 146, 148, as discussed below, allowing the housing base 140 and the cover 144 to be connected or disconnected by hand. Thereby, if desired, the user may clean or replace the impeller 124 by easily decoupling the impeller assembly 120 from the motor 102 and disconnecting the housing base 140 and cover 144 from one another, without the need of tools. Optionally, the entire impeller assembly 120 may be disposed without separating the multipart housing.

In one embodiment, the housing 122 further comprises one or more fluid inlets 150 and one or more discharge nozzles 152, which may be incorporated with the housing cover 144. For example, in one embodiment, the housing cover 144 may include a single fluid inlet 150 located at a center point thereof and a two discharge nozzles 152 which may be positioned and radially outward of the fluid inlet 150, flanking the fluid inlet 150, at its left and right lateral sides, preferably equidistant about the periphery of the housing cover 144. As shown, the fluid inlet 150 and discharge nozzles 152 each include a circular cross-section. However, the inlet(s) 150 and discharge nozzle(s) 152 of the housing 122 may comprise any desired cross-section, such as an ellipsoidal, triangular, or hexagonal cross-section. Each discharge nozzle 152 may comprise a hollow stub 152 that directs the fluid outwardly and perpendicularly from within the housing cover 144. In the example shown, the discharge nozzles 152 all the same cross-section. In other examples, the discharge nozzles 152 can have different cross-sections, such as having one round nozzle and one oval nozzle or some other combinations thereof. In some examples, a directionally controllable tip may be included at the end of each discharge nozzle to control the direction of the outlet jet flow.

Figure 6:
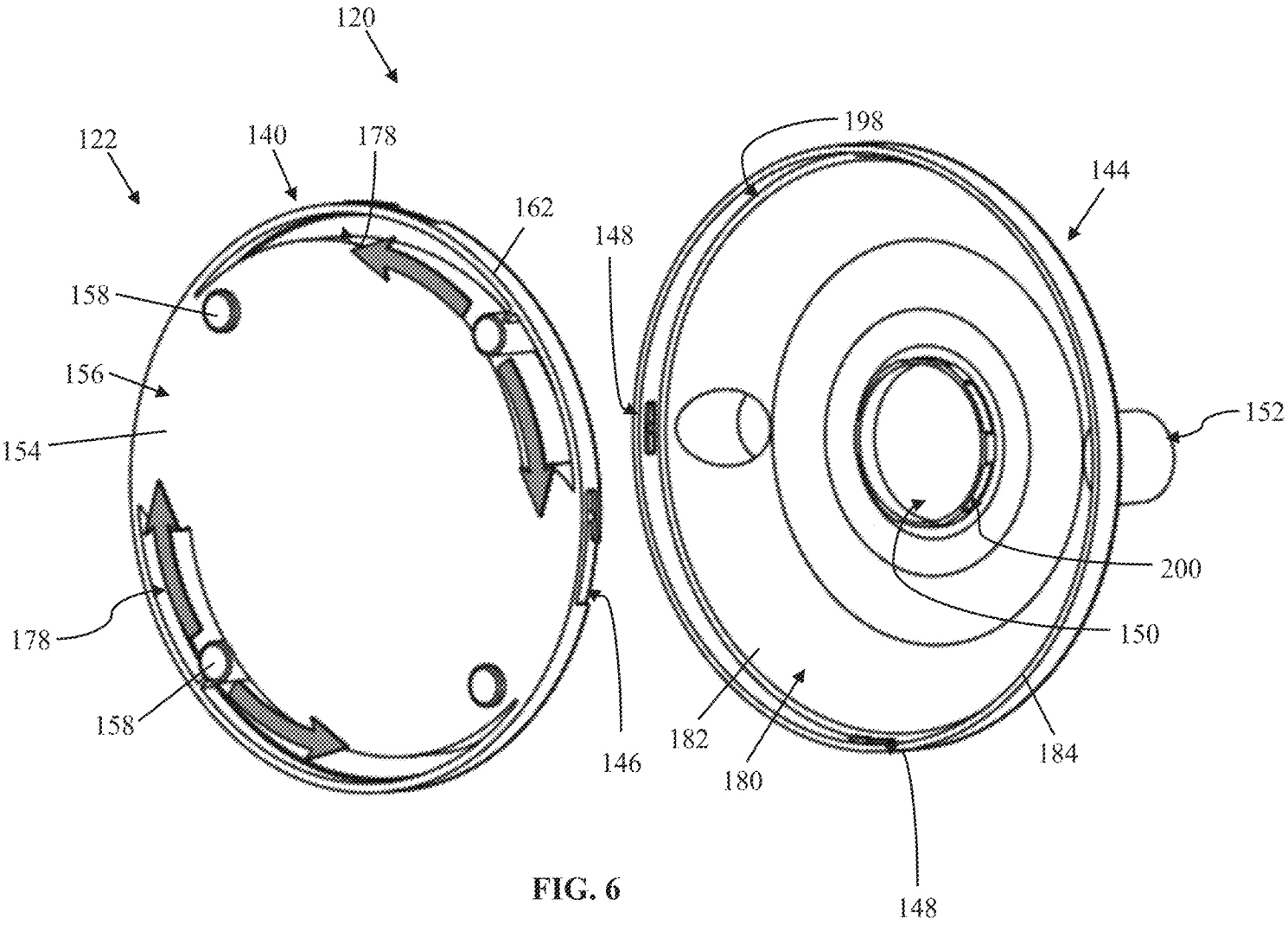
FIG. 6 illustrates a rear perspective and partially exploded view of the impeller of FIG. 4.

The housing base 140 may be configured to collectively attach to the motor 102, locate and mount the impeller 124 within the impeller compartment 142 thereof, and further direct fluid exiting the impeller 124 toward the discharge nozzles 152, as discussed in more detail herein. As shown in FIGS. 2 and 6, a rear, planar wall 154 of a body 156 of the housing base 140 may contact and sit flush against the front end 110 of the motor housing 122 (or mount adapter), when the impeller assembly 120 is properly assembled onto the motor 102. The housing base 140 may be anchored or removably fixed in place on the motor housing 122 by the magnetic pulling force between the first plate 126 and the magnetic drive plate 106 of the motor 102, once the impeller 124, and plates 126, 128 connected thereto, are seated within the impeller compartment 142 of the housing base 140. In more detail, the magnetic holding force, between the magnetic drive plate 106 and the first plate 126, may squeeze the second plate 128 and the housing base 140 against the front end 110 of the motor housing 108 (or the mount adapter), thus securing the housing base 140 onto the motor 102.

To rotationally fix the housing base 140 relative to the motor 102, one or more mating protrusions 158, e.g., annular locating pins or stubs 158 (FIG. 6), may extend laterally or axially (relative to the drive shaft) outward from the rear wall 154 of the of the body 156 of the housing base 140. The stubs 158 are sized and shaped to cooperate with corresponding bores 112 (FIG. 2) formed in the motor housing 108 (or mount adapter). Thereby, when the protrusions 158 of the housing base 140 are seated within bores 112 of the motor housing 108 (or mount adapter), the housing base 140 may be rotationally fixed to the motor housing (or mount adapter), even when the impeller 124 is rotated within the housing base 140. Additionally, the protrusions 158 and the bores 112 allow the impeller assembly 120 to freely translate linearly away from the motor housing 108, allowing the user to pull the impeller assembly 120 away from the motor housing 108 upon overcoming the magnetic holding force between the first plate 126 and the magnetic drive plate 106. The housing base 140 can be provided with the same or fewer number of protrusions 158 as the number of bores 112 within the motor housing 108 (or mount adapter). The protrusions 158 of the housing base 140 may be complimentary in size and shape to the bores 112 of the motor housing 108. Although four stubs and four bores are shown, fewer than four or greater than four stubs and bores may be implemented.

The impeller compartment 142 of the housing base 140 can be defined by a front wall 160 of the body 156 of the housing base 140 (opposite the rear wall 154 which faces toward the motor 102 when the housing base 140 is assembled thereto) and a perimeter wall 162 depending from the body 156 and which extends axially outward from the front wall 160 of the body 156 (toward the housing cover 144). Hence, the impeller compartment 142 may be an open compartment which receives all or a substantial portion of the impeller 124 therein.

As shown in FIG. 2, an impeller pivot post 164 may extend outwardly from the bottom 160 of the impeller compartment 142 (i.e., the front wall 160 of the body 156 of the housing base 140). In an example, the pivot post 164 maybe unitarily formed with the housing base 140. As assembled, the pivot post 164 is configured to extend into a corresponding bore or through hole 166 in the second plate 128. Hence, the pivot post 164 may assist in locating and properly seating the impeller 124 within the impeller compartment 142 and may also define the pivot or rotational axis of the impeller 124.

In one embodiment, as shown in FIG. 2, the impeller compartment 142 of the housing base 140 may further comprise an integrated mounting ring or surface bearing 168 that is circumferentially disposed about and coaxial to the pivot post 164. The mounting ring 168 may be configured to increase the operational efficiency of the impeller 124 by reducing friction between the impeller 124 and the housing base 140. More particularly, since the mounting ring 168 extends axially outward from the bottom wall 160 of the impeller compartment 142, the mounting ring 168 may define a point of contact between the housing base 140 and the impeller 124. The mounting ring 168 may project outwardly or axially from the front wall 160, which defines a lip therebetween. The raised surface of the mounting ring 168 spaces the rear of the impeller 124 from the front wall 160 of the housing base 140 so that the rear of the impeller does not ride or spin directly against the front wall. Hence, the mounting ring 168 may provide a significant reduction in friction between the impeller 124 and the housing base 140 because the second plate 128, which located next the first plate 126 and the two connected to the impeller 124, contacts and rotates against the outer rim of the mounting ring 168 instead of the full surface of the bottom wall 160 of the impeller compartment 142. The mounting ring 168 may be shorter than the pivot post 164 such that the pivot post 164 may extend within the second plate 128, when the impeller 124 is seated within the impeller compartment 142 (FIG. 3).

In one embodiment, the housing base 140 may comprise one or more fluid guide walls 170 which are each configured to guide fluid toward the discharge nozzle(s) 152 of the housing cover 144. For example, as shown, the housing base 140 may include two spaced apart guide walls 170. In an example, the number of fluid guide walls 170 may match the number of fluid discharge nozzles 152. Each fluid guide wall 170 may extend radially outward from the impeller compartment 142 and match the curvature of the outer periphery of the housing base 140. Each guide wall 170 may be located next to and circumferentially surround a corresponding portion of an outer periphery of the impeller 124, when the impeller 124 is seated within the impeller compartment 142. Each fluid guide wall 170 may be tapered in height and thickness so that the fluid is directed radially inward and toward a respective discharge nozzle 152. In more detail, in one embodiment, each fluid guide wall 170 increases in height from a first end 172 to a second end 174 located next to a corresponding discharge nozzle 152, when the housing cover 144 is connected to the housing base 140. Furthermore, in one embodiment, each fluid guide wall 170 increases in thickness (extending radially inward toward the pivot post 164) from the first end 172 to the second end 174. The first end 172 of each guide wall 170 may be beveled to form a smooth transition between the perimeter wall 162 and the guide wall 170 extending radially inward therefrom. In one embodiment, the second end 172 of each guide wall 170 may have a concaved or semi-circular surface profile that corresponds to the size and shape of its corresponding discharge nozzle 152. Thereby, the profiled end 174 of each guide wall 170 may also help direct the fluid out through the corresponding discharge nozzle 152 located downstream thereof. In one embodiment, as shown, each guide wall 170 may also be curved, radially inward, such that an outer surface 176 of the guide wall 170 matches the curvature or contour of the housing cover 144. Therewith, the inner surface (unnumbered) of each guide wall 170 may be concaved (forming a wave-like surface that guides the fluid there along). In one embodiment, to reduce the weight of the housing base 140, each fluid guide wall 170 may be hollow, defining a guide wall cavity 178 at the rear surface 154 of the housing base 140 (FIG. 6).

The housing cover 144 is configured to removably connect to the housing base 140, selectively covering the impeller 124 and a portion of the housing base 140. The housing cover 144 generally includes a body 180 with a rear wall 182, from which a perimeter wall 184 radially extends toward the housing base 140 when assembled, and a front wall 186, opposite the rear wall 182, and within which the fluid inlet(s) 150 and discharge nozzle(s) 152 are located. The rear wall 182 may have a concave surface profile, and the front wall 186 may correspondingly have a convex surface profile.

Figure 5:
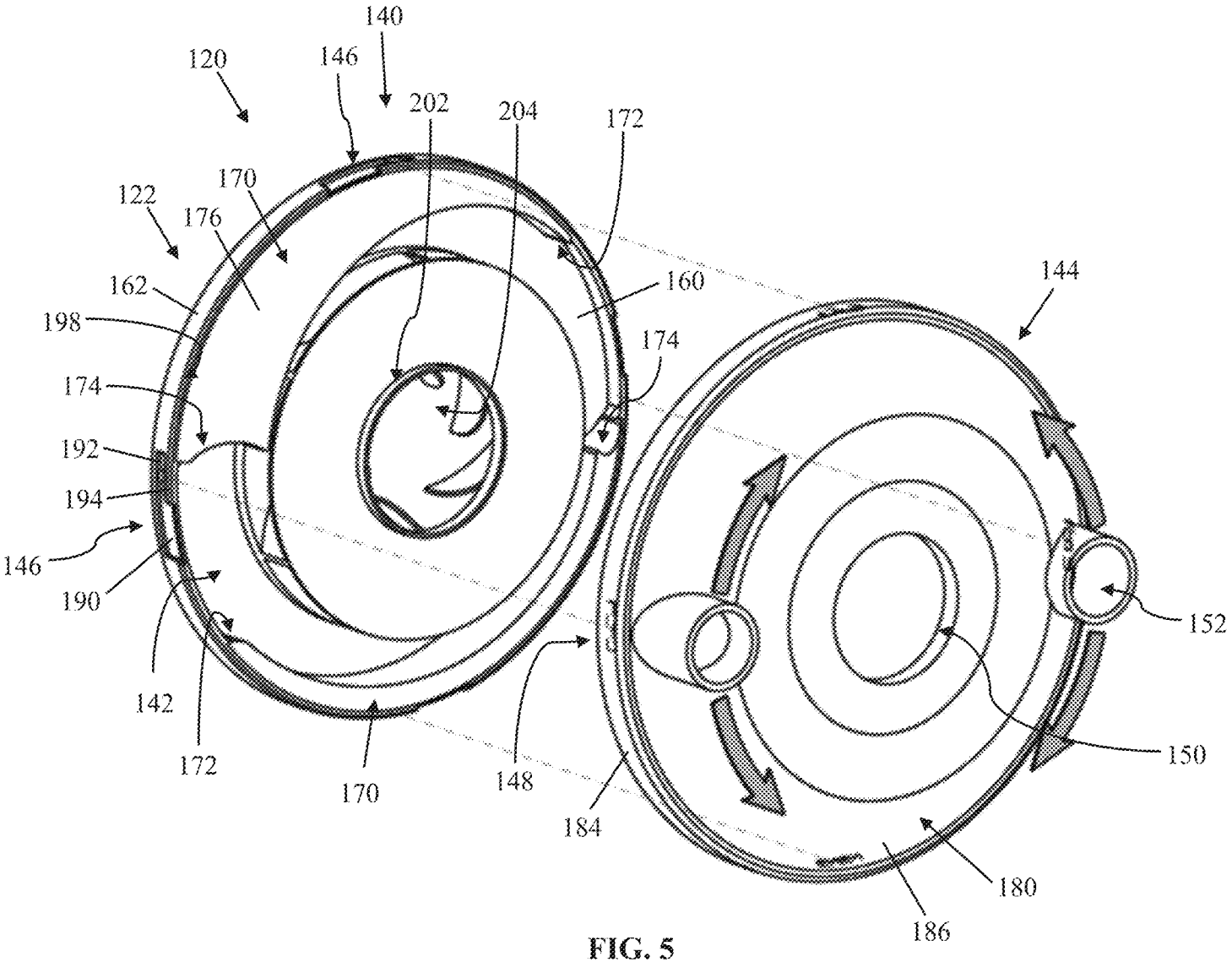
FIG. 5 illustrates a front perspective and partially exploded view of the impeller of FIG. 4, wherein the base and cover portions of the housing are separated from one another and the impeller assembly is fitted within the housing base.

In one embodiment, as shown in FIGS. 5 and 6, the mating features 146, 148 of the housing base 140 and cover 144 may comprise integrated locking features in the form of open recesses or channels 146 in the perimeter wall 162 of the housing base 140 and complimentary protrusions 148 extending from an inner surface of a perimeter wall 184 of the housing cover 144. In one embodiment, each protrusion 148 may be spaced at a distance away from a bottom of the perimeter wall 184, defining a gap or empty space (unnumbered) in between the protrusion 148 and the rear wall 182 of the body 180 of the housing cover 144. In embodiment, each protrusion 148 may comprise one or more knobs or stubs which may be slid and/or press-fit into a respective channel 146.

In operation, to connect the housing base 140 and cover 144 together, each protrusion 148 of the housing cover 144 may be initially aligned with a corresponding channel 146 of the housing base 140. Each protrusion 148 may be axially slid into an open section 190 of each channel 146 (FIG. 5). Thereafter, each protrusion 148 may be rotated into a locking section 192 of the channel 146 (by rotating housing base 140 and/or the cover 144 relative to one another). A locking tab 194, which may define the top wall of the locking section 192 of each channel 146, may slide behind a respective protrusion 148, within the gap between the protrusion 148 and the rear wall 182, when the protrusion 148 is fitted within the locking section 192. Thereby, each protrusion 148 may become linearly locked by a respective locking tab 194, preventing the housing cover 144 from being linearly pulled apart from the housing base 140. The user may perform a reverse operation to disconnect to the housing base 140 and the cover 144 from one another. In another embodiment, the housing base 140 may instead include protrusions and the housing cover 144 may include corresponding channels which receive the protrusions therein. In one embodiment, the perimeter walls 162, 184 of the housing base 140 and cover 144 may each have a diameter that is greater than the body 156, 180 from which the respective perimeter wall 162, 184 extends.

Figure 4:
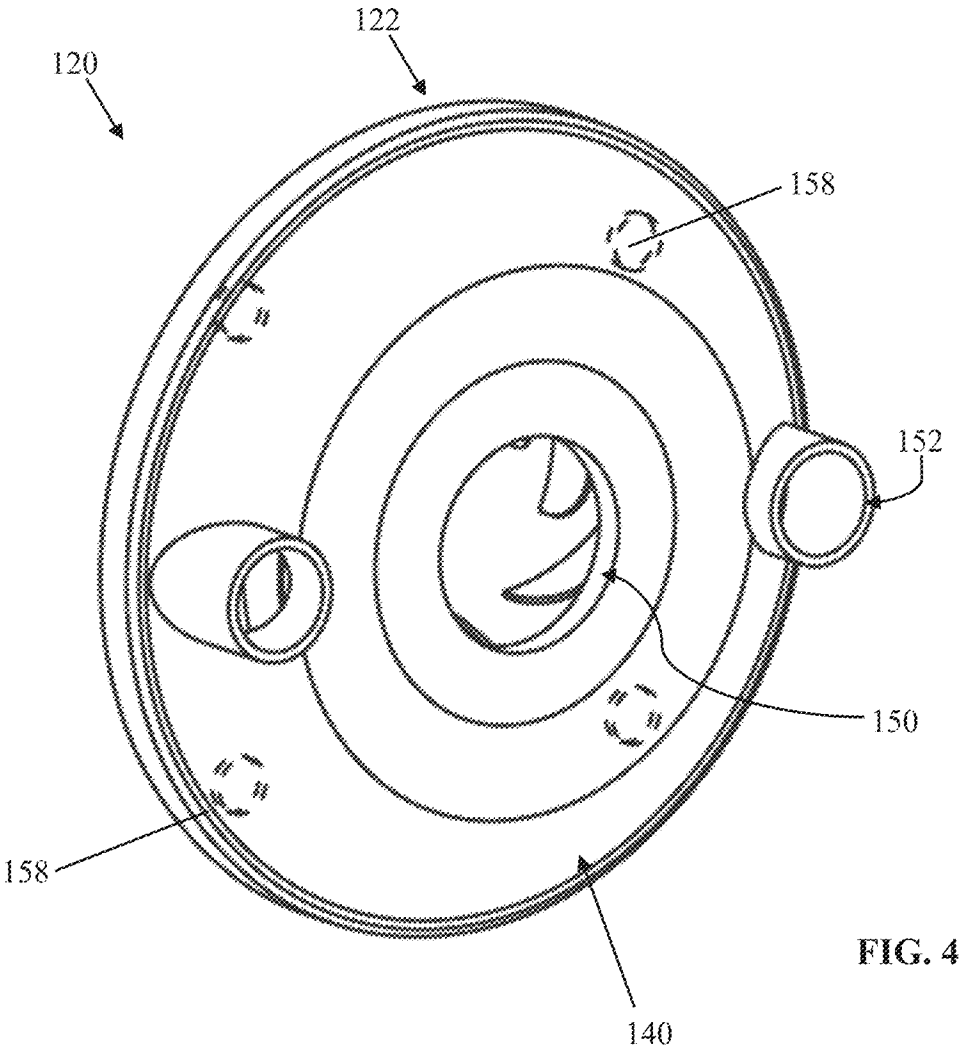
FIG. 4 illustrates a front perspective view of the impeller assembly of the pump of FIG. 1, which generally includes a housing, an impeller disposed within the housing, and a pair of plates connected to the impeller.

In one embodiment, the housing base 140 and cover 144 may each include one or more integrated structural support members for increasing the rigidity of the assembled impeller assembly 120. For example, in one embodiment as shown in FIG. 4, the perimeter wall 184 of the housing cover 144 may define a circumferential lip 184 that is configured to completely extend over and cover the annular perimeter wall 162 of the housing base 140, forming a reinforced connection point at the overlapping perimeter walls 162, 184 of the housing base 140 and cover 144, as well as increasing the hoop strength of the cover. Additionally, in one embodiment, the housing cover 144 may include an additional structural support member in the form of a rim or ledge 196, located in between the perimeter wall 184 and the rear wall 182 of the body 180. When assembled, the rim 196 of the housing cover 144 may abut against a top edge 198 of the perimeter wall 162 (FIG. 5), creating an L-shaped joint between the perimeter walls 162, 184 when the housing base 140 and cover 144 are connected to one another. In other words, when the housing base 140 and cover 144 are connected, the perimeter walls 162, 184 and the rim 196 of the housing cover 144 define a multiplane connection point (i.e., the L-shaped joint or corner) that serves to help axially and radially fix the housing base 140 and cover 144 to one another, when the protrusions 148 of the housing cover 144 are fitted into the channels 146 of the housing base 140.

Furthermore, in one embodiment, the outer surface 176 of each guide wall 170 of the housing base 140 may contact and mate with the rear wall 182 of the housing cover 144, increasing the structural integrity of the assembled housing 122. In more detail, the outer surface 176 of each guide wall 170 may have a curved surface profile that matches the concave surface profile of the rear wall 182 of the housing cover 144, allowing the guide walls 170 to abut and mate with the rear wall 182 of the housing cover 144. Thereby, the guide walls 170 may provide additional contact points between the housing base 140 and cover 144, increasing the strength of the connection therebetween.

In one embodiment, the fluid inlet 150 of the housing cover 144 may include an integrated structural support member for increasing the rigidity of the assembled impeller assembly 120. For example, in one embodiment as shown in FIG. 6, the fluid inlet 150 may include an integrated impeller mating feature in the form of an inlet perimeter wall 200 that extends beyond the rear wall 182 of the body 180 of the housing cover 144 to mate with the impeller 124, forming another contact point and further securing the impeller assembly 120. For example, in one embodiment, the inlet perimeter wall 200 of the housing cover 144 may mate with, e.g., extending over and overlapping, a complimentary inlet perimeter wall or lip 202 at a fluid inlet or eye 204 of the impeller 124. The inlet perimeter wall 200 of the housing cover 144 may have a diameter that is larger than the diameter of the inlet perimeter wall 202 of the impeller 124 such that the inlet perimeter wall 200 of the housing cover 144 fits over and substantially surrounds the inlet perimeter wall 202 of the impeller 124. Thereby, the mating inlet perimeter walls 200, 202 of the housing cover 144 and impeller 124 may help secure the impeller 124 such that impeller 124 is linearly secured in place at its rear and front ends by the pivot post 164 of the housing base 140 and the inlet perimeter wall 200 of the housing cover 144. In another embodiment, the inlet perimeter wall 200 of the housing cover 144 may have a smaller diameter than the diameter of the inlet perimeter wall 202 of the impeller 124 such that the inlet perimeter wall 200 of the housing cover 144 may fit within the inlet perimeter wall 202 of the impeller 124. In one embodiment, a bearing may be included in between the inlet perimeter walls 200, 202 of the housing cover 144 and the impeller 124, reducing frictional forces therebetween. In one embodiment, the inlet perimeter walls 200, 202 may have corresponding mating features, such as protrusions and/or recesses, that mate with one another, for further securing or otherwise ensuring that the impeller 124 is properly aligned.

In one embodiment, the housing base 140 and/or the housing cover 144 may be comprised of a plastic material, such as Polyethylene terephthalate (PET), ABS, polycarbonate, acrylic, etc. In one embodiment, the thickness of the housing base 140 and/or cover may be approximately 1 mm, plus or minus 0.75 mm. Thereby, the housing base 140 and/or the cover may comprise a relatively thin, plastic material but sufficiently rigid for pump use. In one embodiment, as shown in FIG. 3, the housing base 140 and/or cover may comprise internally disposed structural support members that are configured to reinforce the housing. For example, in one embodiment, the housing base 140 and cover 144 may each include internal ribs (not shown) that are configured for increasing the structural integrity thereof. Thereby, by nature of being composed of a thin and reinforced plastic material, the entire impeller assembly 120 may be configured to be cost-effectively disposable and easily replaceable. The impeller assembly 120 may be disposable as desired by the user, for example after a single use or after multiple uses.

Figure 7:
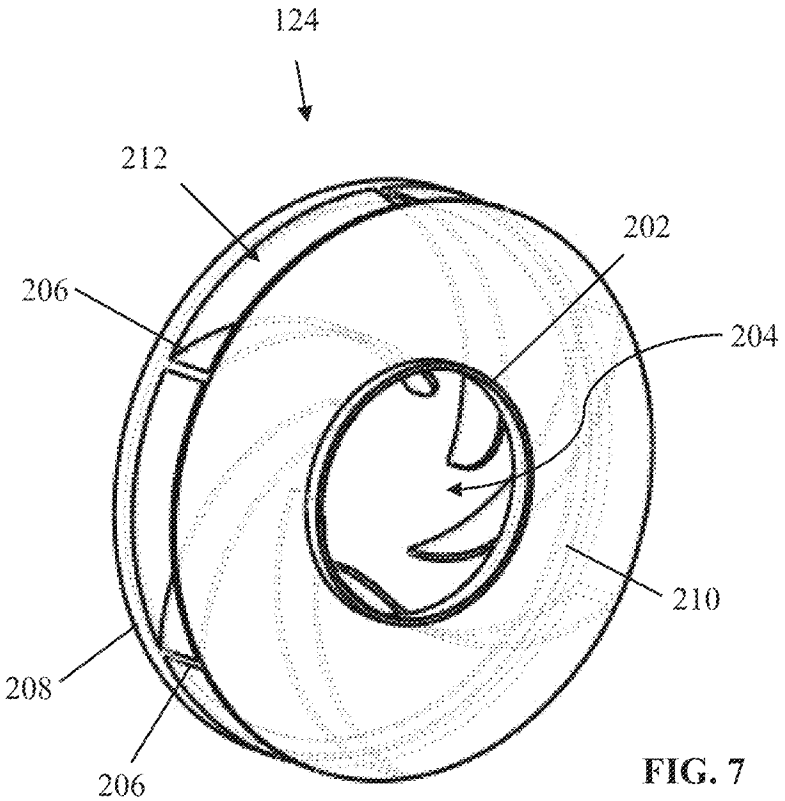
FIG. 7 illustrates a front perspective view of the impeller of the impeller assembly of FIG. 4.
Figure 8:
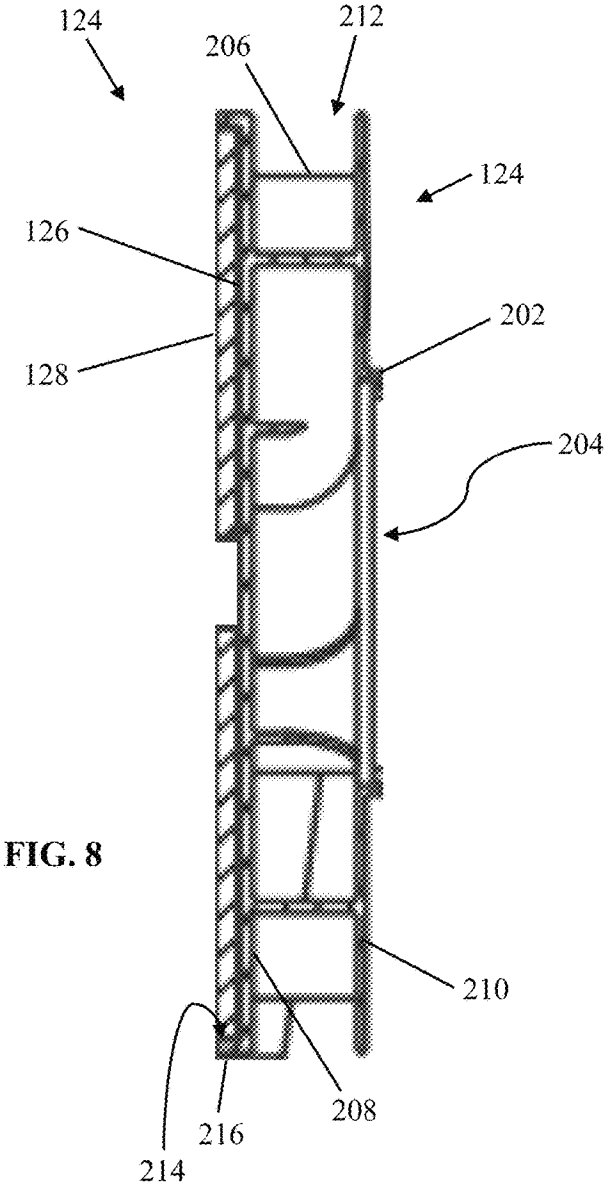
FIG. 8 illustrates a cross-sectional view of the impeller of FIG. 4.

Referring specifically to FIGS. 7 and 8, in one embodiment, the impeller 124 may comprise a closed impeller 124 with vanes 206 enclosed by rear and front walls 208, 210, forming an open periphery 212 (i.e., open side) therebetween. When the impeller 124 is rotated, fluid is suctioned through the fluid inlet or eye 204, compressed by the vanes 206, and expelled radially outwardly at the open periphery 212 of the impeller 124, whereafter the fluid is directed by the guide walls 170 to then flow out through the discharge nozzles 152, generating fluid jet streams exiting therefrom. In one embodiment, as shown, the impeller 124 may include six vanes 206, however the impeller 124 may include any desired number of vanes 206 or multiple stacks of vanes 206. In one embodiment, the vanes 206 may comprise acuate vanes 206 that spiral outwardly from the fluid inlet 204 to the open periphery 212.

In one embodiment, the impeller 124 may be comprised of a plastic material, such as Polyethylene terephthalate (PET), ABS, polycarbonate, acrylic, etc. In one embodiment, the thickness of the impeller 124 may be approximately 1 mm, plus or minus 0.75 mm. Therein, the impeller 124 may comprise a thin plastic material. In one embodiment, the vanes 206 themselves may serve as structural support members to increase the structural integrity of the impeller 124. In one embodiment, the impeller 124 may be formed by plastic injection molding. The impeller 124 in accordance with aspects of the invention is free of magnets. The impeller 124 in accordance with aspects of the invention comprises at least one metallic plate that is magnetically attracted to one or more magnets located externally of the housing 122. The impeller 124 in accordance with aspects of the invention may be made from the same material as the housing 122.

In comparison to known open impellers having the same impeller diameter and rotational speed, the closed impeller 124 as disclosed herein may be more efficient and provide a higher pressure output to create a more powerful fluid jet stream out of the discharge nozzles 152. Additionally, the closed impeller 124 may be more durable and provide for additional attachment points (at the front wall 210 thereof), which may provide a sturdier and more robust impeller assembly 120 in comparison to open impellers, by supporting the vanes to reduce high velocity induced vibrations. However, given that the impeller is a closed impeller, the impeller may be more difficult to maintain and keep clean than a traditional open impeller. Thereby, to offset the potential issues caused by an unclean or clogged closed impeller 124, the entire impeller assembly 120 may be configured to be disposable, allowing the user to cost-effectively interchange impeller assemblies as desired. Further, while it is possible to only discard the closed impeller and re-use the housing, the entire present impeller assembly 120 is configured to be disposable by balancing between cost of manufacture, flow efficiency, and structural integrity, which allow the present jet assembly to provide sufficient jet streams or pressurized outlet flows at a price point that permits application of the jet assembly as a disposable application.

The closed impeller 124 of the disclosed invention is an integrated structural design that provides contact points between the vanes and the front wall 210 to increase the structural rigidity and durability of the impeller 124, and the entire impeller assembly 120. Thus, in one embodiment, the closed impeller 124 and/or the entire impeller assembly 120 may be configured to be disposable to allow the user to cost-effectively and easily replace the impeller assembly 120, or portions thereof, as desired.

The impeller 124 and the pair of metal plates 126, 128 may or may not be rigidly connected to one another. In one embodiment, the impeller 124 and the metal plates 126, 128 may collectively form an impeller subassembly that attaches as a unit to the housing base 140. In such an embodiment, the plates 126, 128 may be rigidly attached to the rear wall 208 of the impeller 124 and/or incorporated within a plate compartment 214 of the impeller 124. As shown in FIG. 8, the rear wall 208 of the impeller 124 may comprise a perimeter wall or rim 216 that defines the plate compartment 214 for receiving the plates 126, 128 therein. Thereby, the plates 126, 128 (having a smaller diameter than the plate compartment 214) may be seated and secure within the plate compartment 214, forming a collective impeller unit. In one embodiment, the plates 126, 128 may be press-fit into the plate compartment 214. In one embodiment, the plates 126, 128 may be rigidly attached to the impeller 124 by one or more fasteners and/or an adhesive. For example, the first plate 126 may first be bonded or glued to the rear wall of the impeller. Then the second plate 128 may be bonded or glued to the first plate.

In another embodiment, the metal plates 126, 128 may not be rigidly attached to the impeller 124 as part of a subassembly, and instead the plates 126, 128 may be individually fitted on the housing base 140 before seating the impeller 124 into the housing base 140. Upon attaching the housing cover 144, a clamping force, which is applied by the housing cover 144 through the inlet perimeter wall 200 thereof, may collectively pinch the impeller 124, the first plate 126, and the second plate 128 against the housing base 140 such that the impeller 124 and the plates 126, 128 are fixed relative to one another and rotate in unison.

The first plate 126 and the second plate 128 may each be comprised of metal and/or a non-metal material embedded with metal particles. In one embodiment, the first plate 126 may comprise a ferrous material, such as steel or another ferrous alloy that is magnetically attractable to a magnet. In one embodiment, the second plate 128 may comprise aluminum or another conductive material. Thereby, the first plate 126 may have a relatively high magnetic attraction with the north or south magnets of the magnetic drive plate 106 of the motor 102, generating a strong magnetic pull therebetween to hold the impeller assembly 120 against the motor 102. Additionally, the second plate 128 may have a relatively high conductivity to generate large eddy currents therein (induced by the alternating magnetic field provided by the rotating magnetic drive plate 106 of the motor 102), creating a strong magnetic braking force and thereby a strong rotational force (or torque) for rotating the plates 126, 128 and impeller 124 in tandem with one another. In one embodiment, the plates 126, 128 may correspond to one another in shape and diameter. Therein, in one embodiment, the plates 126, 128 may have a matching diameter. The diameter of the plates 126, 128 may also substantially match the diameter of the plate compartment 214 and/or the rear wall 208 of the impeller 124. In one embodiment, the thicknesses of the plates 126, 128 may differ from one another to accordingly alter the magnetic effects thereof, as discussed below.

The relative locations and sizes of the plates 126, 128 may augment their desired and respective magnetic effects to linearly retain and rotate the impeller 124. For example, in one embodiment, the second, paramagnetic plate 128 may be located closer to the magnetic drive plate 106 of the motor 102, increasing the strength of the eddy currents therein and reducing the magnetic pull of the first, ferrous plate 126. In more detail, locating the second plate 128 in between the magnetic drive plate 106 and the first plate 126 serves to increase a separation distance between the magnetic drive plate 106 and the first plate 126 (which corresponds in part to the thickness of the second plate 128), reducing a strength of the magnetic pull between the first plate 126 and the magnetic drive plate 106. Additionally, in one embodiment, the second plate 128 may be thicker than the first plate 126, such that the magnetic pull between the first plate 126 and the magnetic drive plate 106 of the motor 102 is appropriately balanced to linearly retain the impeller assembly 120 against the motor housing 108 without introducing unnecessary drag which may retard or otherwise inhibit the rotation of the impeller 124 (caused by a stronger magnetic pulling force of the first plate 126 that may increase the friction between the second plate 128 and the housing base 140). Hence, the larger thickness of the second plate 128, in comparison to the first plate 126, may increase the operating efficiency of the impeller 124.

In more detail, as assembled, the front surface of the first plate 126 may contact the rear wall 208 of the impeller 124 and the front surface of the second plate 128 may contact the rear surface of the first plate 126. The rear surface of the second plate 128 may directly contact the bottom wall 160 of the impeller compartment 142. Therein, once assembled, the second plate 128 may be located closer to the magnetic drive plate 106 of the motor 102 than the first plate 126. The greater thickness of the second plate 128, in comparison to the first plate 126, increases the separation distance of the first plate 126 from the magnetic drive plate 106 of the motor 102 (reducing the magnetic pulling force therebetween). The greater thickness of the second plate 128 also increases the size and effect of the resulting eddy currents therein (generating a greater rotational force to increase the power output of the impeller 124). In one embodiment, the second plate 128 may be twice as thick, or more, than the first plate 126.

Figure 9:
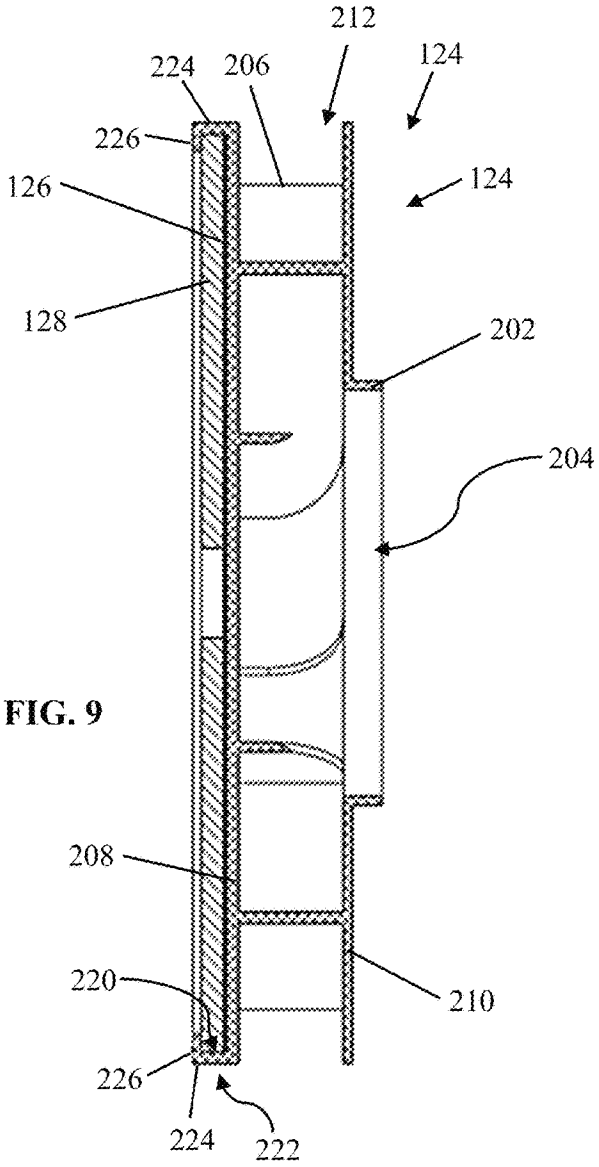
FIG. 9 illustrates a cross-sectional view of another embodiment of an impeller, wherein the plates are internally disposed within a plate compartment of the impeller.

Referring to FIG. 9, there is shown another embodiment of an impeller 124 which includes a completely or partially enclosed plate compartment 220 for housing the plates 126, 128 therein. The plate compartment 220 may be located at the rear wall 208 of the impeller 124. The plate compartment 220 may be defined by a surface of the rear wall 208 and a ledged perimeter wall or rim 222 which includes a first axial section 224 and a second radial or ledge (or cover) section 226 extending axially inward from the first section 224 and parallel to the rear wall 208. Thereby, the plates 126, 128 may be at least partially enclosed within the plate compartment 220, and more particularly the ledge section 226 which at least partially extends over and covers a portion of a rear surface of the second plate 128. In one embodiment, the sections 224, 226 of the perimeter wall 222 may be substantially perpendicular relative to one another. When assembled, the first axially extending section 224 of the plate compartment 220 may contact the outer periphery of each plate 126, 128, and the second ledge section 226 may extend over a portion of the second plate 128, thereby linearly locking the plates 126, 128 within the plate compartment 220 yet still allowing the rear surface of the second plate 128 to be exposed such that the second plate 128 may directly contact the housing base 140 and thereby magnetically engage with the magnetic drive plate 106 of the motor 102.

In one embodiment, the impeller 124, as shown in FIG. 9, may be formed by plastic injection molding. Therein, the impeller 124 can be formed by injection molding a plastic layer around the first and second plates 126, 128, at least partially encasing the plates 126, 128 within the body of the impeller 124. In one embodiment, the plate compartment 220 may be completely closed for fully encasing the plates 126, 128 therein.

Figure 10:
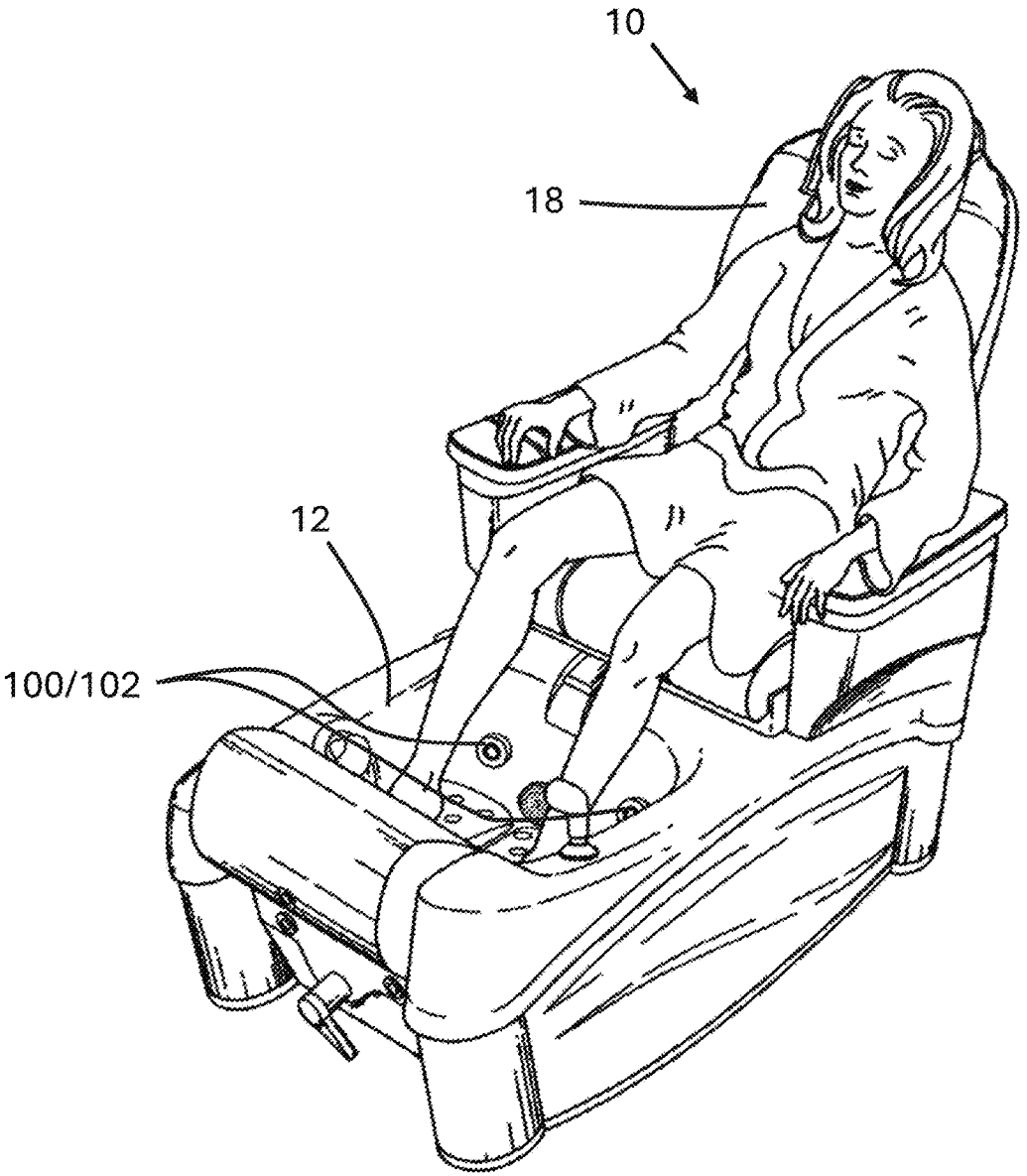
FIG. 10 illustrates a perspective view of a spa device in the form of a spa chair with multiple magnetic drive pumps therein.
Figure 11:
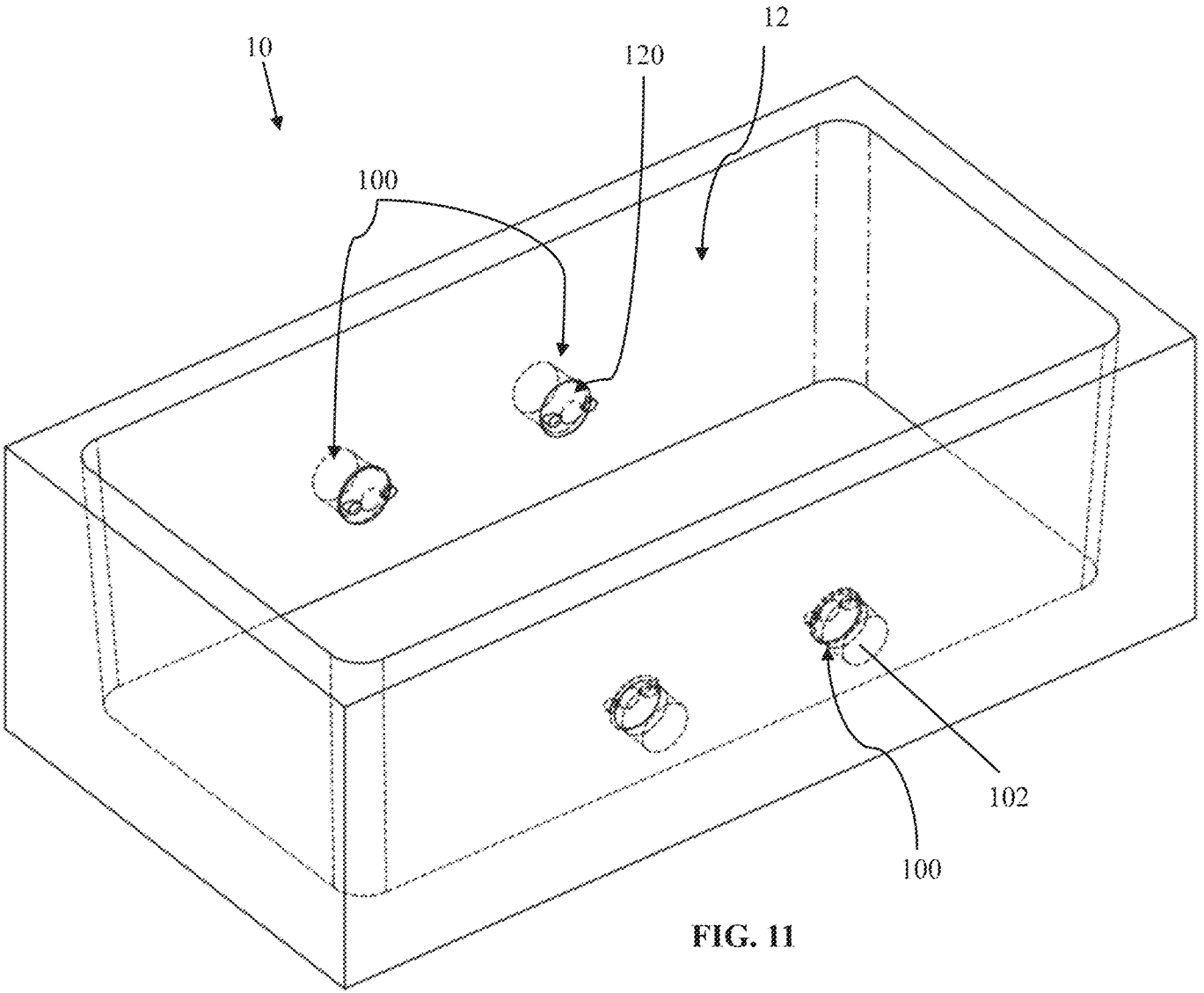
FIG. 11 illustrates a perspective view of another spa device in the form of a bathtub with multiple magnetic drive pumps therein.
Figure 12:
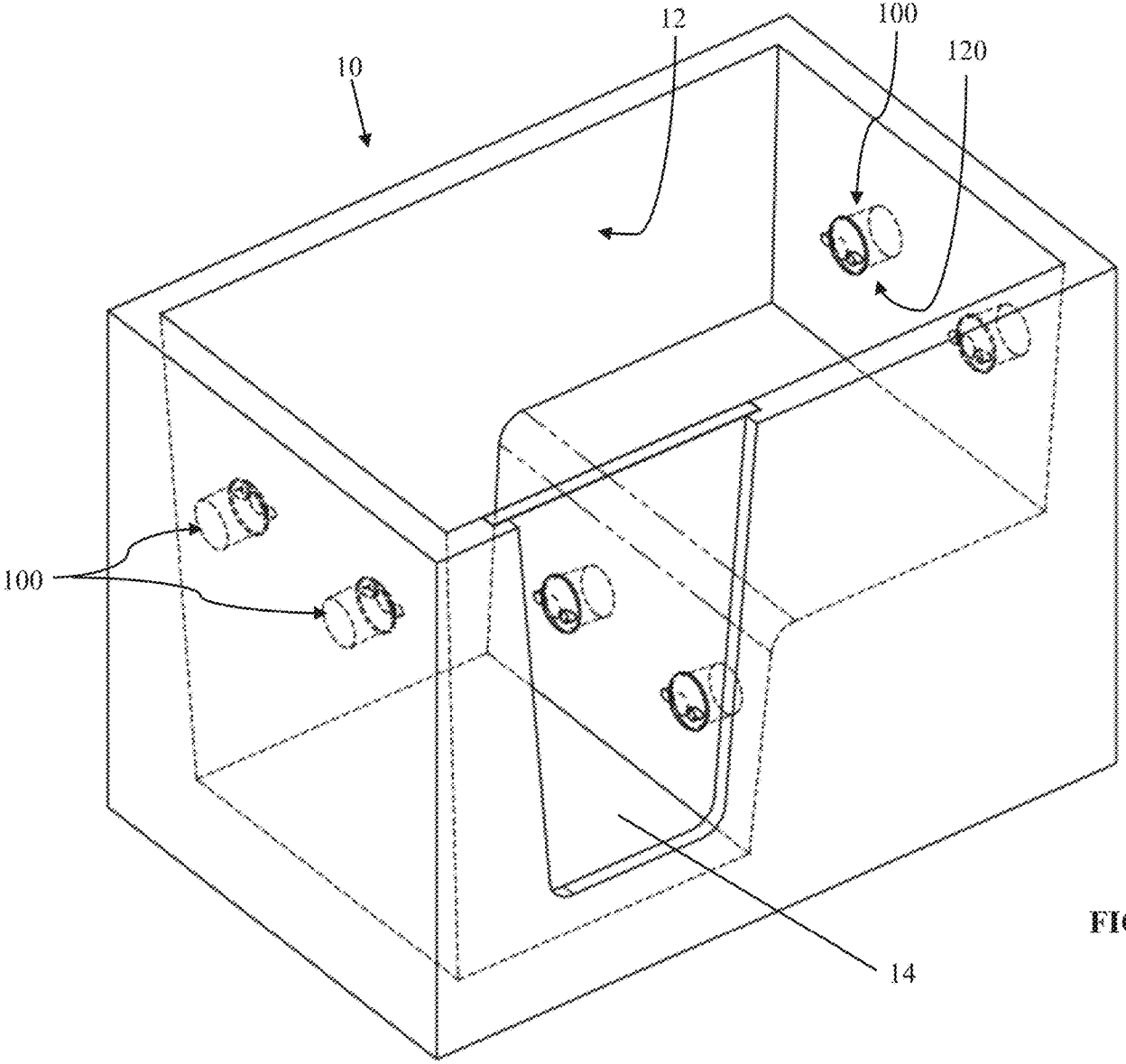
FIG. 12 illustrates a perspective view of another spa device in the form of a walk-in bathtub with multiple magnetic drive pumps therein.

Referring to FIGS. 10-13, there are shown possible use cases for the spa pump 100 in various spa devices 10. As shown in FIG. 10, one or more spa pumps 100 may be incorporated into a spa chair 10, such as the spa chair as disclosed in US Pub. No. 2022/0000710, as referenced above. Therein, each spa pump 100 may be fitted within a basin 12 of the spa chair 10 for providing a hydrotherapy experience for the user seated in the seat 18 of the spa chair 10. As shown in FIG. 11, the spa pump 100 may also be used in a bathtub 10. More particularly, each spa pump 100 can be fitted within a respective through hole in the tub wall 12 of the bathtub 10. Therein, the motor 102, as shown in phantom, may be housed and protected within the body of the bathtub 10, and the impeller assembly 120 may be exposed and extend beyond the tub wall 12 for intaking and expelling the water within the bathtub 10. As shown in FIG. 12, the spa pump 100 may also be incorporated into a walk-in bathtub 10, which may have a tub wall 12 and a door 14 in a sidewall thereof, allowing the user to enter or exit the bathtub 10 upon opening and closing the door 14 thereof. In each of the depicted exemplary use cases, the spa pumps 100 may be at least partially housed within the body of the spa device 10, reducing the apparent noise of the motor 102 and also protecting the motor from water exposure. Additionally, each impeller assembly 120 of each spa pump 100 may be configured to be disposable and replaceable after one or more uses, allowing the spa devices 10 to remain sanitary and effective for providing the desire hydrotherapy experience.

Methods of making and of using a shaftless magnetic drive pump to turn an impeller and a spa device having the shaftless magnetic drive pump and components thereof are within the scope of the invention as disclosed herein. By shaftless magnetic drive pump, it is understood that the impeller is not directly coupled to a rotating drive shaft.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Although limited embodiments of spa pumps and spa devices, such as spa chairs and bathtubs, and methods of assembly and operation thereof, have been specifically described and illustrated herein, many modifications and variations will be apparent to those skilled in the art. The method steps disclosed herein can be performed in a differing order as desired. The disclosure is also defined in the following claims.

Example Embodiments

The following are numbered example embodiments of the apparatuses, devices, systems, and methods related to spa pumps and spa devices which incorporate spa pumps therein. The below listing of examples or any other examples disclosed herein may be combined in whole or in part. Elements of the examples disclosed herein are not limiting.

Example 1. A pump for a spa device including a motor having a drive shaft and a magnetic drive plate attached thereto. The pump further includes an impeller assembly magnetically coupled to the magnetic drive plate of the motor. The impeller assembly is configured to be disposable.

Example 2. The impeller assembly can comprise at least two housing parts and an impeller, and wherein the impeller is disposable the at least two housing parts are reusable, or the impeller and the at least two housing parts are all disposable after a one-time use, after two uses, or after three uses, with each use being a bath or a spa session.

Example 3. The impeller and the at least two housing parts can be made from the same plastic material.

Example 4. The impeller may be have a receiving area having a lip for receiving one or more metallic plates.

Example 5. The receiving area can have a round perimeter defined by the lip, and is open to atmosphere.

Example 6. The one or more metallic plates can include a first metallic plate attached to the impeller, and a second metallic plate attached to the impeller and in contact with the first metallic plate.

Example 7. The first metallic plate can be solid and the second metallic plate can have a central opening.

Example 8. The at least two housing parts can include a stub or a post, and the stub or post can project through the central opening of the second metallic plate.

Example 9. The post does not project through the first metallic plate.

Example 10. The assembly, system, device, apparatus, and method of any of the above Examples alone or in combination, wherein the impeller assembly comprises a housing having at least one inlet and at least one discharge nozzle and an impeller housed within the housing. The impeller includes a plurality of vanes configured to generate a fluid stream expelled out through the at least one discharge nozzle. The impeller assembly further includes a first plate connected to a rear surface of the impeller. The first plate is comprised of a ferrous material. The first plate is configured to magnetically engage with the magnetic drive plate of the motor for generating an axial magnetic force for fixing the impeller, and the housing therewith, relative to the motor from axially displacing from the motor housing, or from a mount adapter.

Example 11. The assembly, system, device, apparatus, and method of any of the above Examples alone or in combination, wherein the impeller assembly further comprises a second plate connected to the first plate.

Example 12. The second plate is comprised of a paramagnetic material. The second plate is configured to magnetically engage with the magnetic drive plate of the motor to rotate the impeller via a braking force generated by eddy currents within the second plate.

Example 15. The assembly, system, device, apparatus, and method of any of the above Examples alone or in combination, wherein the magnetic drive plate of the motor comprises a series of alternating north and south magnets configured to induce an alternating north and south magnetic field through the second plate.

Example 16. The assembly, system, device, apparatus, and method of any of the above Examples alone or in combination, wherein the first plate is comprised of steel.

Example 17. The assembly, system, device, apparatus, and method of any of the above Examples alone or in combination, wherein the second plate is comprised of aluminum.

Example 18. The assembly, system, device, apparatus, and method of any of the above Examples alone or in combination, wherein the second plate is thicker than the first plate.

Example 19. The assembly, system, device, apparatus, and method of any of the above Examples alone or in combination, wherein the second plate covers at least a portion of the first plate.

Example 20. The assembly, system, device, apparatus, and method of any of the above Examples alone or in combination, wherein the first and second plates have a matching diameter.

Example 21. The assembly, system, device, apparatus, and method of any of the above Examples alone or in combination, wherein each of the first and second plates has a perimeter that is polynomial in shape.

Example 22. The assembly, system, device, apparatus, and method of any of the above Examples alone or in combination, wherein the first and second plates each have a diameter that is less than a diameter of a rear wall of the impeller.

Example 23. The assembly, system, device, apparatus, and method of any of the above Examples alone or in combination, wherein the first and second plates are configured to be housed or mounted within a plate compartment at the rear wall of the impeller.

Example 24. The plate compartment can comprise a surface of a rear wall of the impeller and a lip or projection.

Example 25. The lip or projection can form a round perimeter and the height of the lip measured from the surface of the rear wall can define a receiving depth that is sized to receive the first and second plates in a flush configuration such as that no part of either the first and second plates project upwardly beyond the height of the lip.

Example 26. The lip or projection can form a round perimeter and the height of the lip measured from the surface of the rear wall can define a receiving depth that is sized to receive the first and second plates and wherein at least part of the second plate projects upwardly beyond the height of the lip.

Example 27. The assembly, system, device, apparatus, and method of any of the above Examples alone or in combination, wherein the first and second plates each comprise a discoidal plate.

Example 28. The assembly, system, device, apparatus, and method of any of the above Examples alone or in combination, wherein the housing comprises a housing base removably connected to the motor. The housing base includes an impeller compartment configured to receive the impeller therein.

Example 29. The assembly, system, device, apparatus, and method of any of the above Examples alone or in combination, wherein the housing comprises a housing cover removably connected to the housing base and configured to cover the impeller. The housing cover includes the at least one inlet and at least one discharge nozzle therein.

Example 30. The assembly, system, device, apparatus, and method of any of the above Examples alone or in combination, wherein the housing cover includes a single fluid inlet.

Example 31. The single fluid inlet can have zero objection within the perimeter of the inlet.

Example 32. The single fluid inlet can be covered with a latticework within the perimeter of the inlet.

Example 33. The assembly, system, device, apparatus, and method of any of the above Examples alone or in combination, wherein the housing cover includes a pair of discharge nozzles.

Example 34. In some examples, at least one of the two discharge nozzles include a directionally controllable tip to change the direction of flow discharging out the outlet.

Example 35. The assembly, system, device, apparatus, and method of any of the above Examples alone or in combination, wherein the discharge nozzles flank the left and right sides of the single fluid inlet.

Example 36. The assembly, system, device, apparatus, and method of any of the above Examples alone or in combination, wherein the housing base comprises a pivot post extending outwardly from an impeller-facing surface of the impeller compartment thereof. The pivot post is configured to extend through a pivot hole of the second plate such that the pivot post mounts and defines an axis of rotation of the impeller when the impeller is seated within the impeller compartment of the housing base.

Example 37. The assembly, system, device, apparatus, and method of any of the above Examples alone or in combination, wherein the pivot post extends into the second plate.

Example 38. The assembly, system, device, apparatus, and method of any of the above Examples alone or in combination, wherein the impeller compartment further comprises a mounting ring circumferentially and coaxially disposed about the pivot post. The mounting ring defining a stationary bearing surface upon which the second plate, and impeller therewith, rotates.

Example 39. The assembly, system, device, apparatus, and method of any of the above Examples alone or in combination, wherein the housing base comprises at least one fluid guide wall configured to guide fluid toward the at least one discharge nozzle of the housing cover.

Example 40. The assembly, system, device, apparatus, and method of any of the above Examples alone or in combination, wherein the at least one fluid guide wall extends radially outward from the impeller compartment, circumferentially surrounding a corresponding portion of an outer periphery of the impeller.

Example 41. The assembly, system, device, apparatus, and method of any of the above Examples alone or in combination, wherein the at least one fluid guide wall increases in height from a first end to a second end located next to the at least one discharge nozzle of the housing, when the housing cover is connected to the housing base.

Example 42. The assembly, system, device, apparatus, and method of any of the above Examples alone or in combination, wherein the at least one guide wall tapers in thickness, increasing in its thickness from the first end to the second end located next to the at least one discharge nozzle of the housing.

Example 43. The assembly, system, device, apparatus, and method of any of the above Examples alone or in combination, wherein the first end of the at least one guide wall is beveled, creating a smooth transition point from a perimeter wall from which the at least one guide wall extends.

Example 44. The assembly, system, device, apparatus, and method of any of the above Examples alone or in combination, wherein the second end of the at least one guide wall includes a concave wall that corresponds to the shape and size of the opening of the discharge nozzle, for guiding the fluid into the discharge nozzle.

Example 45. The assembly, system, device, apparatus, and method of any of the above Examples alone or in combination, wherein the at least one guide wall is curved, from its bottom to top, such that an outer surface of the at least one guide wall corresponds to and mates with a corresponding curved surface of the housing cover.

Example 46. The assembly, system, device, apparatus, and method of any of the above Examples alone or in combination, wherein the at least one guide wall comprises a first guide wall and a second guide wall, and wherein each of the first two guide walls comprises a first end having a narrow tip and a second end having a concave wall.

Example 47. The first and second guide walls are located proximate the perimeter of the housing base, and wherein the first end of the first guide wall is spaced from the second end of the second guide wall by a first gap, and the second end of the first guide wall is spaced from the first end of the second guide wall by a second gap.

Example 48. Wherein fluid circulated by the impeller is blocked by the concave wall at the second end of the first guide wall and the fluid is re-directed out the discharge nozzle located at the second end of the first guide wall.

Example 49. Wherein fluid circulated by the impeller is blocked by the concave wall at the second end of the second guide wall and the fluid is re-directed out the discharge nozzle located at the second end of the second guide wall.

Example 50. Wherein fluid circulated by the impeller is blocked by the concave wall at the second end of the first guide wall and blocked by the concave wall at the second end of the second guide wall, and wherein fluid is re-directed out the two discharge nozzles when blocked by the two concave surfaces.

Example 51. The assembly, system, device, apparatus, and method of any of the above Examples alone or in combination, wherein the housing base and the housing cover comprise complimentary mating features configured to allow a user to connect or disconnect the housing base and the housing cover by hand.

Example 52. The assembly, system, device, apparatus, and method of any of the above Examples alone or in combination, wherein the housing base comprises a plurality of channels in a perimeter wall thereof, and the housing cover comprises a plurality of protrusions in a perimeter wall thereof that are configured to slidably engage with the channels of the housing base.

Example 53. The assembly, system, device, apparatus, and method of any of the above Examples alone or in combination, wherein the housing base comprises an annular perimeter wall, and the housing cover comprises a circumferential lip configured to extend over and cover the annular perimeter wall of the housing base.

Example 54. The assembly, system, device, apparatus, and method of any of the above Examples alone or in combination, wherein the housing cover comprises a single inlet in the form of a through hole located at a center point of the housing cover.

Example 55. The assembly, system, device, apparatus, and method of any of the above Examples alone or in combination, wherein an impeller mating feature in the form of an inlet perimeter wall extends inwardly from the inlet. The impeller mating feature is configured to engage with a complimentary fluid inlet of the impeller.

Example 56. The assembly, system, device, apparatus, and method of any of the above Examples alone or in combination, wherein the impeller mating feature is in the form of an inlet perimeter wall that extends around and at least partially covers a corresponding inlet perimeter wall surrounding a fluid inlet of the impeller.

Example 57. The assembly, system, device, apparatus, and method of any of the above Examples alone or in combination, wherein the housing of the impeller assembly comprises a plastic material.

Example 58. The assembly, system, device, apparatus, and method of any of the above Examples alone or in combination, wherein the housing of the impeller assembly comprises a thin plastic material.

Example 59. The assembly, system, device, apparatus, and method of any of the above Examples alone or in combination, wherein the housing of the impeller assembly comprises internally disposed structural support members configured to reinforce the housing.

Example 60. The assembly, system, device, apparatus, and method of any of the above Examples alone or in combination, wherein the housing of the impeller assembly comprises ribs internally disposed within the housing.

Example 61. The assembly, system, device, apparatus, and method of any of the above Examples alone or in combination, wherein the impeller is a closed impeller with covered vanes.

Example 62. The assembly, system, device, apparatus, and method of any of the above Examples alone or in combination, wherein the closed impeller comprises a rear wall and a front wall, covering the vanes therebetween.

Example 64. The assembly, system, device, apparatus, and method of any of the above Examples alone or in combination, wherein the vanes of the impeller comprise arcuate vanes which spiral radially outwardly toward an outer periphery of the impeller.

Example 65. The assembly, system, device, apparatus, and method of any of the above Examples alone or in combination, wherein the closed impeller includes a first, rear contact point and a second, front contact point for increasing the structural integrity of the impeller assembly.

Example 66. The assembly, system, device, apparatus, and method of any of the above Examples alone or in combination, wherein the motor comprises a motor housing which houses the magnetic drive plate.

Example 67. The assembly, system, device, apparatus, and method of any of the above Examples alone or in combination, wherein the motor housing includes a front wall. The front wall of the motor housing comprises a plurality of recesses therein.

Example 68. The assembly, system, device, apparatus, and method of any of the above Examples alone or in combination, wherein the housing of the impeller assembly comprises a back wall with a plurality of protrusions extending rearwardly therefrom. The plurality of protrusions is complimentary to and configured to fit within the plurality of recesses of the front wall of the motor housing, rotationally fixing the housing of the impeller assembly onto the motor housing, when the housing of the impeller assembly is connected to the motor housing.

Example 69. The assembly, system, device, apparatus, and method of any of the above Examples alone or in combination, wherein the motor further comprises a mount adapter configured to mount the motor housing to a wall of the spa device. The mount adapter is further configured to mount the impeller assembly thereon.

Example 70. A pump for a spa device including a motor having a drive shaft and a magnetic drive plate attached thereto. The pump further includes an impeller assembly that comprises a housing having at least one inlet and at least one discharge nozzle and an impeller housed within the housing. The impeller includes a plurality of vanes configured to generate a fluid stream expelled out through the at least one discharge nozzle. The impeller assembly further includes a first plate connected to a rear surface of the impeller. The first plate is comprised of a ferrous material. The first plate is configured to magnetically engage with the magnetic drive plate of the motor for linearly and removably connecting the impeller, and the housing of the impeller assembly therewith, to the motor. The impeller assembly further includes a second plate connected to and covering the first plate. The second plate is comprised of a paramagnetic material. The second plate is configured to magnetically engage with the magnetic drive plate of the motor to rotate the impeller via a braking force generated by resulting eddy currents within the second plate.

Example 71. The assembly, system, device, apparatus, and method of any of the above Examples alone or in combination, wherein the impeller is configured to be removable by hand such that the impeller is readily disposable and replaceable.

Example 72. The assembly, system, device, apparatus, and method of any of the above Examples alone or in combination, wherein the housing is configured to be detachable by hand without the need of tools.

Example 73. The assembly, system, device, apparatus, and method of any of the above Examples alone or in combination, wherein the entire impeller assembly is configured to be disposable after one or more uses.

Example 74. The assembly, system, device, apparatus, and method of any of the above Examples alone or in combination, wherein the impeller assembly, including the housing and/or the impeller thereof, is configured to be disposable and replaceable by hand without the need of tools.

Example 75. A method of assembling a spa pump including attaching a motor having a drive shaft and a magnetic drive plate attached thereto. The magnetic drive plate includes a series of north and south magnets. The method further includes attaching a pair of plates to an impeller. The pair of plates includes a first, ferrous plate and a second, paramagnetic plate. The method further includes placing the impeller, with the plates attached thereto, within a housing. The method further includes removably attaching the housing onto the motor. The first and second plates are configured to magnetically couple the impeller to the magnetic drive plate of the motor such that the housing is held against the motor via an axial magnetic force generated by the first plate, and the impeller rotates within the housing via a rotational magnetic force generated by the second plate.

Example 76. A method of replacing an impeller assembly of a magnetic drive spa pump. The method including grabbing and pulling an impeller assembly away from the motor, overcoming an axially directed magnetic pulling force between a ferrous plate within the impeller and a magnetic drive plate of the motor. The method further includes disposing the impeller assembly. The method further includes attaching a new impeller assembly onto the motor by locating the impeller assembly next to the motor and allowing the axially directed magnetic pulling force between the ferrous plate and the magnetic drive plate magnetically connect and hold the impeller assembly onto the motor.

Example 77. A method of using a shaftless magnetic drive pump comprising a motor, a mount adapter attached to the motor, and an impeller assembly attached to the mount adapter, and wherein the impeller assembly, which comprises an impeller and a multi-part housing, is discarded after three or fewer uses, with each use being a discrete spa treat session or a discrete bath session.

What is claimed is:

1. A pump for a spa device, comprising:

a motor having a drive shaft and a magnetic drive plate attached thereto; and an impeller assembly magnetically coupled to the magnetic drive plate of the motor, wherein the impeller assembly is configured to be disposable and comprises:

a housing having at least one inlet and at least one discharge nozzle;

an impeller housed within the housing, the impeller comprising a plurality of vanes located between a front wall and a rear wall, the plurality of vanes configured to generate a fluid stream expelled out through the at least one discharge nozzle, the front wall having a continuous outer perimeter; and a first plate connected to a rear surface of the rear wall of the impeller, the first plate comprised of a ferrous material, the first plate configured to magnetically engage with the magnetic drive plate of the motor for generating an axial magnetic force for linearly fixing the impeller, and the housing therewith, relative to the motor.

2. The pump of claim 1, wherein the rear wall is solid and the front wall of the impeller has a centrally located fluid inlet.

3. The pump of claim 2, wherein the impeller assembly further comprises:

a second plate connected to the first plate, the second plate comprised of a paramagnetic material.

4. The pump of claim 3, wherein the first plate is solid and the second plate has a centrally located through opening.

5. The pump of claim 3, wherein:

the first plate is comprised of steel; and the second plate is comprised of aluminum.

6. The pump of claim 3, wherein the second plate is thicker than the first plate.

7. The pump of claim 3, wherein the rear wall of the impeller comprises an axial section defining a plate compartment, and wherein the first plate and the second plate are located in the plate compartment.

8. The pump of claim 2, wherein the housing comprises:

a housing base removably connected to the motor and comprising an impeller compartment configured to receive the impeller therein; and a housing cover removably connected to the housing base and configured to cover the impeller inside the impeller compartment, the housing cover including the at least one inlet and at least one discharge nozzle therein.

9. The pump of claim 4, wherein a housing base of the housing comprises a pivot post extending from the housing base, the pivot post configured to extend through the centrally located through opening of the second plate and the pivot post terminates adjacent the first plate.

10. The pump of claim 8, wherein the housing base comprises:

at least one fluid guide wall configured to guide fluid toward the at least one discharge nozzle of the housing cover;

the at least one fluid guide wall circumferentially surrounding a corresponding portion of an outer periphery of the impeller; and the at least one fluid guide wall increasing in height from a first end to a second end located next to the at least one discharge nozzle of the housing, when the housing cover is connected to the housing base.

11. The pump of claim 8, wherein the housing base and the housing cover comprise complimentary mating features configured to allow a user to connect or disconnect the housing base and the housing cover by hand.

12. The pump of claim 8, wherein the housing base comprises an annular perimeter wall, and the housing cover comprises a circumferential lip configured to extend over and cover the annular perimeter wall of the housing base.

13. The pump of claim 8, wherein the housing cover comprises:

a single inlet at a center point of the housing cover; and the single inlet is aligned with the centrally located fluid inlet of the front wall of the impeller.

14. The pump of claim 2, wherein the housing of the impeller assembly comprises an open periphery between the front wall and the rear wall.

15. The pump of claim 2, wherein the housing of the impeller assembly comprises internally disposed structural support members configured to reinforce the housing.

16. The pump of claim 2, wherein each of the plurality of vanes of the impeller comprises a first edge attached to the front wall and a second edge connected to the rear wall.

17. The pump of claim 2, further comprising a mount adaptor connected to the motor;

the mount adaptor houses the magnetic drive plate and comprises a plurality of recesses therein; and the housing of the impeller assembly comprises a back wall with a plurality of protrusions extending rearwardly therefrom, wherein the plurality of protrusions is complimentary to and configured to fit within the plurality of recesses of the mount adaptor, rotationally fixing the housing of the impeller assembly onto the mount adaptor, when the housing of the impeller assembly is connected to the mount adaptor.

18. A pump for a spa device, comprising:

a motor having a drive shaft and a magnetic drive plate attached thereto; and an impeller assembly comprising:

a housing having at least one inlet and at least one discharge nozzle;

an impeller housed within the housing, the impeller comprising a plurality of vanes configured to generate a fluid stream expelled out through the at least one discharge nozzle;

a first plate connected to a rear surface of the impeller, the first plate comprised of a ferrous material, the first plate configured to magnetically engage with the magnetic drive plate of the motor for linearly and removably connecting the impeller, and the housing of the impeller assembly therewith, to the motor;

a second plate connected to and covering the first plate, the second plate comprised of a paramagnetic material;

wherein the second plate comprises a centrally located through opening and the first plate is solid at a central area thereof; and wherein the impeller comprises a front wall and a rear wall and the plurality of vanes are located between the front wall and the rear wall.

19. The pump of claim 18, wherein the housing comprising a housing base removably attached to a housing cover, said housing base comprising a pivot post that projects through the through opening of the second plate and terminate adjacent the first plate.

20. The pump of claim 18, wherein a rear wall of the impeller is solid and a front wall of the impeller has a centrally located fluid inlet.

21. The pump of claim 20, wherein the rear wall is made from a thin plastic material that is about 1 mm thick, plus or minus 0.75 mm.

22. The pump of claim 19, wherein the housing base is made from a thin plastic material that is about 1 mm thick, plus or minus 0.75 mm.

23. The pump of claim 18, wherein each of the plurality of vanes of the impeller comprises a first edge attached to the front wall and a second edge connected to the rear wall.

24. A method of assembling a spa pump comprising:

attaching a motor having a drive shaft and a magnetic drive plate attached thereto to a mount adaptor, the magnetic drive plate comprising a series of north and south magnets;

attaching a pair of plates to an impeller, the pair of plates comprising a first, ferrous plate and a second, paramagnetic plate;

placing the impeller, with the plates attached thereto, within a housing;

removably attaching the housing onto the mount adaptor;

wherein the first and second plates are configured to magnetically couple the impeller to the magnetic drive plate of the motor such that the housing is held against the mount adaptor via an axial magnetic force generated by the first plate;

wherein the impeller is rotatable within the housing via a rotational magnetic force generated by the second plate; and wherein the second plate comprises a body with a single through opening located centrally of the body.

25. The method of claim 24, wherein the housing comprises a housing base removably attached to a housing cover, each of the housing base and the housing cover is made from a thin plastic material that is about 1 mm thick, plus or minus 0.75 mm.

26. The method of claim 25, further comprising projecting a pivot post on the housing base through the single centrally located through opening on the second plate.

27. The method of claim 26, wherein the first plate is solid and a tip of the pivot post terminates adjacent the first plate.

28. The method of claim 27, wherein the impeller comprises a plurality of vanes located between a front wall having a centrally located opening and a rear wall.

29. The method of claim 28, wherein each of the plurality of vanes of the impeller comprises a first edge attached to the front wall and a second edge connected to the rear wall.

* * * * *